United States Patent [19]

Perron

[11] Patent Number: 4,825,847

[45] Date of Patent: May 2, 1989

[54] AIR FURNACE SYSTEM

[76] Inventor: Joseph Perron, 44 - 7th Avenue 7, Lac St. Augustin Nord, Canada, G0A 3E0

[21] Appl. No.: 254,833

[22] Filed: Sep. 30, 1988

[51] Int. Cl.[4] ..... F24F 3/14

[52] U.S. Cl. ..... 126/113; 126/99 R; 219/276; 219/362; 237/78 R; 236/44 C

[58] Field of Search ..... 126/113, 99 R, 117; 237/78 R, 78 A, 50, 11; 219/362, 271, 272, 276; 236/44 A, 44 R, 44 C

[56] References Cited

U.S. PATENT DOCUMENTS

| | | | |
|---|---|---|---|
| 2,035,628 | 3/1936 | Whitmer et al. . | |
| 2,424,927 | 7/1947 | Garvey et al. | 126/113 |
| 2,804,870 | 9/1957 | Chelini | 126/113 |
| 3,211,437 | 10/1965 | Jaye | 126/113 X |
| 3,952,181 | 4/1976 | Reed | 126/113 X |
| 4,136,731 | 1/1979 | DeBoer . | |
| 4,139,762 | 2/1979 | Pohrer et al. | 126/113 X |
| 4,210,102 | 7/1980 | Dosmann . | |
| 4,239,956 | 12/1980 | Morton | 126/113 X |
| 4,564,746 | 7/1986 | Morton et al. | 219/362 X |
| 4,697,735 | 10/1987 | Temple | 237/78 R X |
| 4,706,884 | 11/1987 | Brauer | 126/113 X |

FOREIGN PATENT DOCUMENTS

| | | |
|---|---|---|
| 392144 | 10/1940 | Canada . |
| 870351 | 5/1971 | Canada . |
| 1130677 | 8/1982 | Canada . |

*Primary Examiner*—Larry Jones

[57] ABSTRACT

A warm air furnace system comprising a closed casing having an air inlet and an air outlet duct, a fan to draw air from the air inlet toward the air outlet duct, a water tank mounted into the warm air furnace casing, a radiator anchored to the warm air furnace casing in proximate register with its air inlet and connected to the water tank by a water intake line and by a water outlet line. A heating element is immersed in the water tank, to heat up to a first threshold temperature the water. A pump recirculates the water from the tank to the radiator and back. A water vapor by-pass tube interconnects the water tank to the air outlet duct, so as to humidify the air warmed by the radiator.

13 Claims, 2 Drawing Sheets

AIR FURNACE SYSTEM

FIELD OF THE INVENTION

The present invention relates to heating systems for residential dwellings.

BACKGROUND OF THE INVENTION

In the U.S. Pat. No. 2,035,628 issued Mar. 31, 1936 in the names of Whitmer and Macy, there is shown a radiator being provided with cooling means whereby moisture is supplied to the heated air in a controlled manner. More particularly, there is provided a water basin 51 over which is mounted a rotatable disk 43 and a cone 44. A motor 40 rotates disk 43 and cone 44 at a high speed whereby water from basin 51 is centrifugally elevated adjacent the inner wal of the cone and caused to flow through the opening between the disk and flange of the hub 42 of the disk 43. A fine mist is thereby produced, both to wash and humidify the air warmed by the radiator.

Such an air humidifying contraption is merely an addition to an existing warm air furnace. It is therefore somewhat inefficient in design.

OBJECTS OF THE INVENTION

A primary object of the invention is to increase the efficiency of warm air furnaces.

Another object of the invention is to provide an integral warm air furnace and humidifier system.

An object of the present invention is to provide a warm air furnace system in which the heating system and the humidifier system works concurrently.

Other objects of the invention will appear to the careful reader in the detailed description of the drawings.

SUMMARY OF THE INVENTION

In accordance with the objects of the invention, there is disclosed a warm air furnace system comprising a closed casing having an air inlet and an air outlet duct, fan means to draw air from the air inlet toward said air outlet duct, a water tank mounted into said casing, a radiator anchored to said casing in proximate register with said air inlet and connected to said water tank by a water intake line and by a water outlet line; first electrical heating means, to heat up to a first threshold temperature the water in said water tank; pump means, to circulate water from the tank to the radiator and back; and a water vapour by-pass channel member, interconnecting said water tank to said air outlet duct so as to humidify the air warmed by said radiator.

Preferably, there is further included closure means to control the rate of escape of water vapour through said by-pass channel member.

Advantageously, there is further included second electrical heating means, to heat up to a second threshold temperature was water intake line and/or said water outlet line above said first threshold temperature.

Profitably, said second electrical heating means is an electrically controled heating tube, anchored to said closed casing, said water inlet and outlet lines each coiling a number of times around said heating tube, the coiled water lines sections and said heating tube being enclosed in an insulated closed compartment within said closed casing.

Preferably, said closure means includes a flap, guiding rails to guide said flap to slide between a first position in which it closes said water vapour by-pass channel member and a second position in which the channel member is opened, an electrical motor and a pivotal lever connected to a drive axle of the latter motor and adapted to reciprocate said flap upon rotation of the latter drive axle.

There is advantageously further included warm air furnace control means comprising: thermostat means, to control the temperature of the water in said water tank via a thermal probe and an operative connection to said first electrical heating means; preferably means to control the degree of humidity of air at said air outlet duct, via a hygrometer and an operative connection to said closure means; and profitably means to control actuation/disengagement of said second electrical heating means.

Said first threshold temperature could be in the range of 65° to 80° C. and said second threshold temperature in the range of 90°-95° C. The ratio of power outputs of the two said heating means could be about 3 to 1.

It is envisioned that there be further included a float valve member, to monitor the level of water in said water tank, a water feed line being operatively connected to said float valve member to feed water into the tank whenever evaporation has brought the water level below a predefined lower limit threshold.

DETAILED DESCRIPTION OF THE INVENTION

Figure 1:
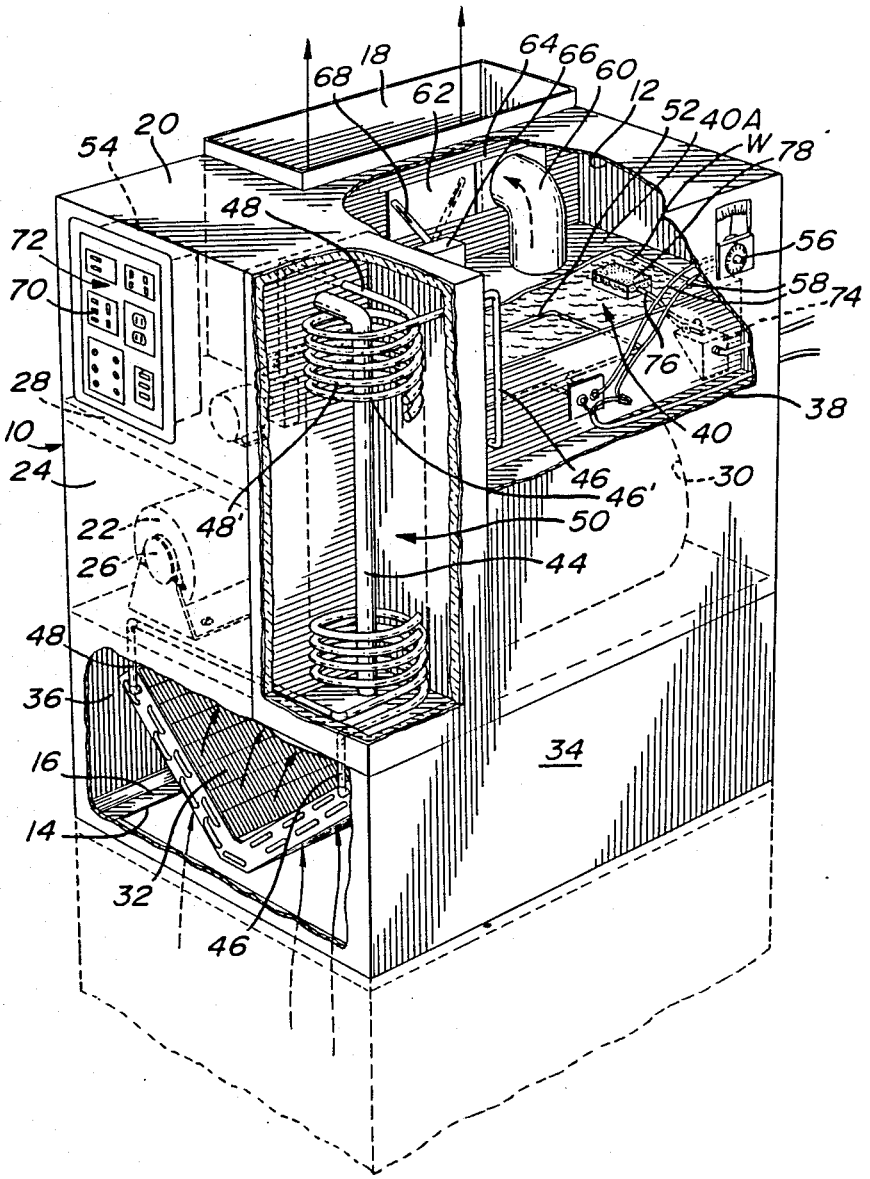
FIG. 1 is a partly broken perspective view of a warm air furnace system according to a preferred embodiment of the invention.
Figure 2:
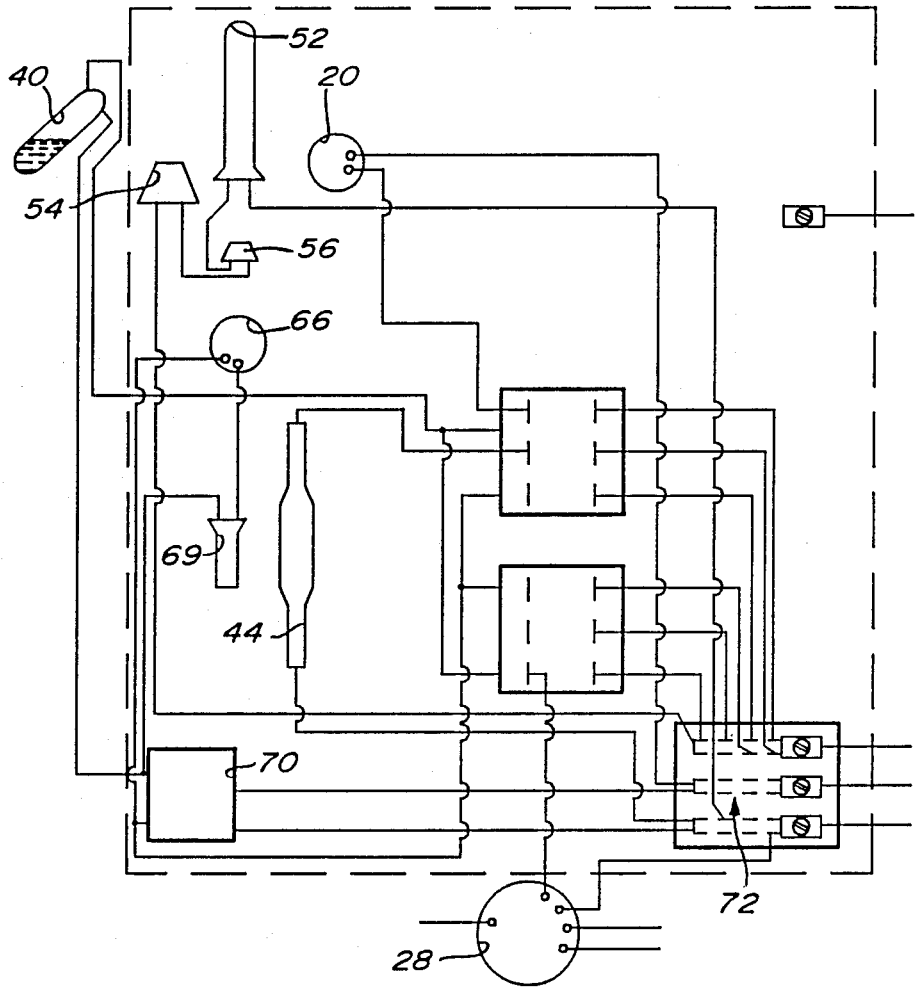
FIG. 2 is a diagrammatic view representing the electrical network of the elements constituting the warm air furnace system of the invention.

The warm air furnace 10 consists of a closed metal box-like casing 12 having a large air inlet opening 14 at its bottom wall 16 and a smaller air outlet duct 18 opening at one rear corner of its top wall 20. A large fan 22 is rotatably mounted to the opposite side walls 24 of the casing 12 by a horizontal axle 26, which is driven by an electrical motor 28. Fan 22 defines a number of large blades 30. A heat generating radiator 32 is anchored to the front and rear walls 34–36 of warm air furnace housing 12, said radiator being cross-sectionally V-shaped and positioned between air inlet 14 and fan 22 so that blades 30 be adapted to sweep a substantial portion of the interior faces of the two legs of the V-radiator. Two horizontal partitions 38–40 are anchored to walls 24, 34, 36 above fan 22 but below top wall 20, so as to define therebetween a large box-like basin or reservoir 42 for holding water W. Reservoir 42 is installed at the front corner of warm air furnace casing 12 in register with the level of aperture 18.

About a box-like compartment 50 in the upper corner of casing 12 opposite outlet duct 18, is mounted a heating tube 44 which extends vertically for about half the height of the warm air furnace 10. Radiator 32 is connected to reservoir 42 by two hoses 46, 48 wherein the water W from the reservoir can circulate from the reservoir to the radiator and back. Hoses 46, 48 engage into compartment 50 and come to coil around heating tube 44 a number of times, at 46' 48'.

A water pump 54 recirculates the water W along the lines 46–48. A thermostat 56 is mounted to front wall 34 and is operatively connecte to a reservoir 42, through first electric cables 58. Thermostat 56 monitors the temperature of water W.

A large elbowed duct 60 interconnects the top wall 40A of compartment 40 to an opening in the front wall of outlet duct 18. The downstream end of duct 60 is closable by a plate or flap 62 which is horizontally slidable along guiding rails 64 on the front wall of duct 18, from an open to a closed position. Sliding motion of flap 62 is controlled by an electric motor 66 (anchored to wall 40A) via a pivotal lever 68 connected to a driving axle of motor 66. Motor 66 is itself controled by a hygrometer 69 about air duct 18, via a transformer 70 in an electrical control panel 72 at the fourth and last upper rear corner of the casing 12.

Water feed in reservoir 40 is controlled by a conventional float valve 74 provided with a pivotal lever 76 anchored to a float 78 and connected to a water line 80, wherein downward pivotal of lever 76 caused by decrease in the water level due to evaporation through duct 60 and outlet 18, will progressively open valve 74 to bring water W from line 80 into reservoir 40 until a predefined water level in reservoir 40 is restored.

In operation, fan motor 28 is actuated to rotate fan blades 30, to circulate air from bottom air inlet 14 toward top air outlet 18. Heating element 52 (preferably having a 1,000 Watts output) is engaged to heat water W in reservoir 40 up to a fixed temperature in the range of 65 to 80 degrees Celsius (°C.). Flap 62 is fully opened, partially opened or closed accordingly with the needs and automatically controled by control panel 72 via motor 66, so that in view of the rising water vapour pressure in the reservoir 40, vapour be allowed to progressively escape through duct 60 and outlet 18. The level of water W in reservoir 40 is maintained constant by valve 74.

Now, should there be a need for a higher level of heat being produced and/or more particularly an increased level of water vapour pressure, pump 20 is actuated to recirculate water W along hoses 46–48, and heating tube 44 (preferably having an output of 3,000 Watts) is energized to heat coils 46', 48' in order to bring the water up to a temperature in the range of about 90° to 95° C., for a limited time period.

It is known that the rate of increase of vapour pressure of water below 100° C., with respect to temperature, is not a linear function. Indeed, for a 23% increase in temperature, between 65° and 80° C., there will be a 89% increase in vapour pressure, between 188 and 355 millimeters of mercury (mm Hg); and for a 19% increase in temperature, between 80° C. and 95° C., there will be a 79% increase in vapour pressure, between 355 mm Hg and 634 mm Hg. That is to say, vapour pressure of water at 65° C. is only about 0.25 atmosphere (atm) (188/760 mm Hg), while it more than triples for only a 30° C. increase in temperature, at 0.83 atm (634/760 mm Hg). [ref.: CRC Press; <<Handbook of Chemistry and Physics>>, 53rd edition]

Hence, assembly 44, 46', 48' is especially efficient in raising the vapour pressure for a small expenditure of energy (until the boiling point is reached), so as to substantially increase the relative humidity in the heated air escaping through air outlet 18.

What I claim is:

1. A warm air furnace system comprising a closed casing having an air inlet and an air outlet duct, fan means to draw air from the air inlet toward said air outlet duct, a water tank mounted into said casing, a radiator anchored to said casing in proximate register with said air inlet and connected to said water tank by a water intake line and by a water outlet line; first electrical heating means, to heat up to a first threshold temperature the water in said water tank; pump means, to circulate water from the tank to the radiator and back; and a water vapour by-pass channel member, interconnecting said water tank to said air outlet duct so as to humidify the air warmed by said radiator.

2. A warm air furnace system as defined in claim 1, further including closure means to control the rate of escape of water vapour through said by-pass channel member.

3. A warm air furnace system as defined in claim 2, wherein said closure means includes a flap, guiding rails to guide said flap to slide between a first position in which it closes said water vapour by-pass channel member and a second position in which the channel member is opened, an electrical motor and a pivotal lever connected to a drive axle of the latter motor and adapted to reciprocate said flap upon rotation of the latter drive axle.

4. A warm air furnace system as defined in claim 1, further including second electrical heating means, to heat up to a second threshold temperature said water intake line above said first threshold temperature.

5. A warm air furnace system as defined in claim 4, further including warm air furnace control means comprising: thermostat means, to control the temperature of the water in said water tank via a thermal probe and an operative connection to said first electrical heating means.

6. A warm air furnace system as defined in claim 5, said warm air furnace control means further including means to control the degree of humidity of air at said air outlet duct, via a hygro meter and an operative connection to said closure means.

7. A warm air furnace system as defined in claim 6, said warm air furnace control means further including means to control actuation/disengagement of said second electrical heating means.

8. A warm air furnace system as defined in claim 4, wherein said first threshold temperature is in the range of 65° to 80° C. and said second threshold temperature is in the range of 90°–95° C.

9. A warm air furnace system as defined in claim 4, wherein the ratio of power outputs of the two said electrical heating means is about 3 to 1.

10. A warm air furnace system as defined in claim 1, further including second electrical heating means, to heat up to a second threshold temperature said water outlet line above said first threshold temperature.

11. A warm air furnace system as defined in claim 1, further including second electrical heating means, to heat up to a second threshold temperature said water inlet and outlet lines above said first threshold temperature.

12. A warm air furnace system as defined in claim 11, wherein said second electrical heating means is an electrically controlled heating tube, anchored to said closed casing, said water inlet and outlet lines each coiling a number of times around said heating tube, the coiled water lines sections and said heating tube being enclosed in an insulated closed compartment within said closed casing.

13. A warm air furnace system as defined in claim 1, further including a float valve member, to monitor the level of water in said water tank, a water feed line being operatively connected to said float valve member to feed water into the tank whenever evaporation has brought the water level below a predefined lower limit threshold.

* * * * *